United States Patent [19]

Bez

[11] Patent Number: 5,058,896

[45] Date of Patent: Oct. 22, 1991

[54] BOARD GAME

[76] Inventor: Jacques R. Bez, 7227 Deborah Dr., Falls Church, Va. 22046

[21] Appl. No.: 549,249

[22] Filed: Jul. 5, 1990

Related U.S. Application Data

[63] Continuation of Ser. No. 324,731, Jun. 5, 1990, abandoned.

[51] Int. Cl.[5] ..... A63F 3/00

[52] U.S. Cl. ..... 273/272; 273/258; 273/275

[58] Field of Search ..... 273/236, 242, 248, 258, 273/271, 272, 275; 434/159, 160, 167

[56] References Cited

U.S. PATENT DOCUMENTS

| | | | |
|---|---|---|---|
| 1,553,835 | 9/1925 | Peters | 273/272 |
| 3,309,092 | 3/1967 | Hardesty et al. | 273/275 |
| 3,342,493 | 9/1967 | Lang | 273/272 |
| 3,414,264 | 12/1968 | Schriber | 273/248 |
| 3,472,514 | 10/1969 | Green | 273/272 |
| 4,014,548 | 3/1977 | Trilling | 273/272 |
| 4,190,255 | 2/1980 | Hughes | 273/272 |
| 4,252,323 | 2/1981 | Levinrad | 273/272 |
| 4,448,423 | 5/1984 | Augusta | 273/285 |
| 4,637,609 | 1/1987 | Vanderhoof | 273/272 |

FOREIGN PATENT DOCUMENTS

| | | | |
|---|---|---|---|
| 1107303 | 12/1955 | France | 273/272 |
| 465979 | 5/1937 | United Kingdom | 273/258 |
| 1219839 | 1/1971 | United Kingdom | 273/272 |
| 2114898 | 9/1983 | United Kingdom | 273/275 |

*Primary Examiner*—Edward M. Coven
*Assistant Examiner*—William M. Pierce
*Attorney, Agent, or Firm*—Sixbey, Friedman, Leedom & Ferguson

[57] ABSTRACT

An educational tool in the form of a word game is disclosed. Each player starts on his own colored starting point at the bottom of the game area. Each player is represented by a colored alphabet set of blocks that are selected before the start of the game. During successive turns, the players must travel up and across the board by forming words while using one letter from the previous word, and must return the remaining letters to a return section of a tray with the letters facing down. All the letters used by a player from his selector holder to form a word must be substituted by the letters from a surplus section of a supply tray. To accomplish their goal and win the game, the players must enter their respective color goal or finish point on the top of the game area. If in a turn more than one player reaches his goal, the winner will be the one having the most letters in his color goal.

3 Claims, 5 Drawing Sheets

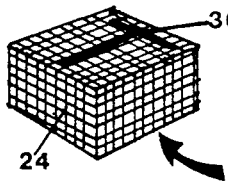
FIG·2
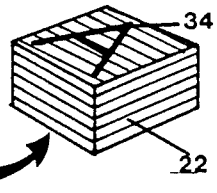
FIG·3
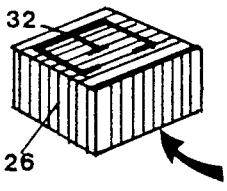
FIG·4
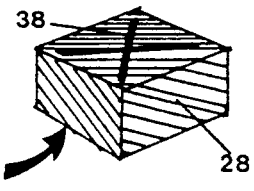
FIG·5
FIG·6
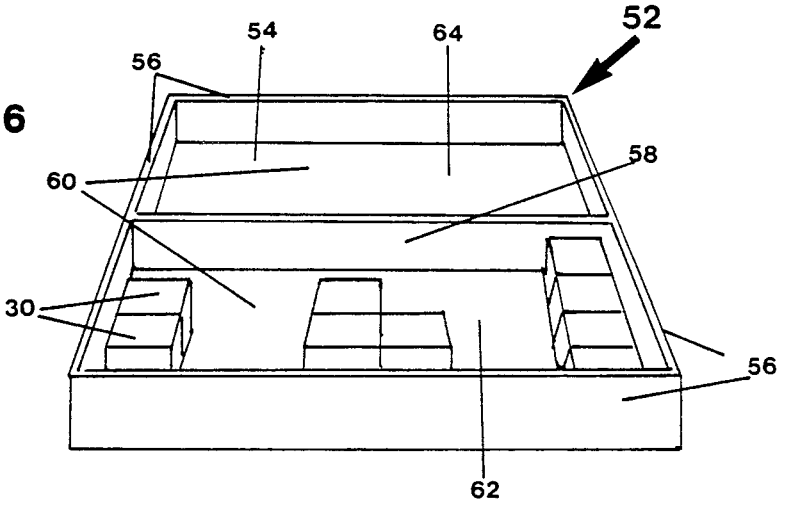
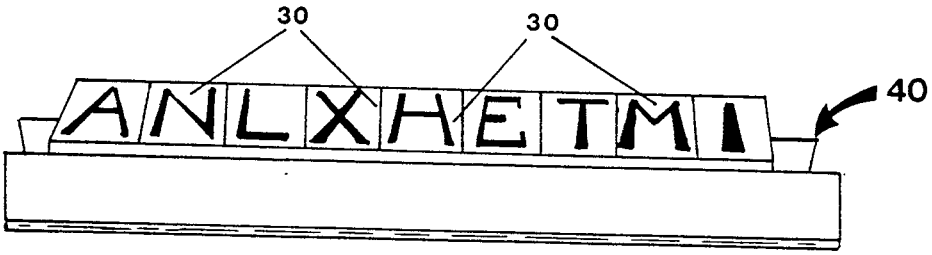
FIG·7

BOARD GAME

This application is a continuation of Ser. No. 324,731, filed June 5, 1990, now abandoned.

BACKGROUND OF THE INVENTION

1. Field of the Invention

The present invention relates to a board game apparatus having playing blocks carrying alphabetic consonants and vowels which are color-coded in order to distinguish each players' blocks. The blocks are used to form moving colored words wherein the player who reaches a finishing point first is declared the winner.

2. Description of the Prior Art

Word games have existed in various forms dating back to before the turn of the century. The most popular of which is marketed under the tradename SCRABBLE. Examples of this type of word game are set forth in U.S. Pat. No. 1,553,835 issued to Peters and U.S. Pat. No. 4,252,323 issued to Levinrad. However, this type of word game is directed toward the accumulation of points by creatively building what may be considered a crossword puzzle on the game board.

Other types of word games have also been developed such as that disclosed in U.S. Pat. No. 4,637,609 issued to Vanderhoof which includes a rotating playing surface which allows a portion of the board to be selectively positioned before any one of four players. Initially, each player builds on his respective portion of the board for a given time period before the board is rotated and the next player is given a chance to block the previous players' progress. This continues until (1) one of the competitors has used the last of his playing pieces, (2) one of the competitors calls for the start of a "FINAL" playing phase, or (3) all of the competitors declaring that they can make no further moves. It should be noted that this game is complex in nature and is not in actuality a race from one position to another but merely an accumulation of point totals which determines a winner.

Clearly there is a need for a simplistic word game which is competitive in nature and which can be used as an educational tool.

SUMMARY OF THE INVENTION

This invention combines an unusual board game in which a colored starting point, a colored goal or finish and colored blocks distinguish each player from one another. The board apparatus is designed to eliminate the element of chance, provide utility of use and is of significant educational value.

One object of the present invention is to provide a game board for playing a competitive game, for players of various ages. This is carried out by the game where in the course of which each player forms their own words by juxtaposing colored blocks. The playing pieces include references indicated on the top surface, to indicate alphabetic letters. The board is a hard flat surface grided with colored, black and colorless squares which have important meaning in the course of the game. The base section of the game area is wider than the top and has identified colored starting point for each of the players. The top section of the game area is approximately one-third to one-fourth the size of the base where the game begins and includes identified colored goals or finishing points for each of the players. Each player is distinguished by a different color set.

Another object of the game is to provide a simple educational tool which is played by forming different colored words and starting at the base of the game area. Each player starts on his own colored starting point. Each player is represented by a colored alphabet set of blocks that are selected before the start of the game. During successive turns, the players must travel up and across the board by forming words while using one letter from the previous word, and must return the remaining letters to a return section of a tray with the letters facing down. All the letters used by a player from his selector holder to form a word must be substituted by the letters from a surplus section of the tray. To accomplish their goal and win the game, the players must enter the color goal on top of the game area. If in a turn more than one player reaches his goal, the winner will be the one having the most letters in his color goal. Along with the game board, there is a set of colored blocks, a selector block holder and a tray having return and surplus sections for each player. There is also a rotary lazy Susan which may be supplied with a game board for four players such that the game board may be easily positioned before the player whose turn it is.

For a fuller understanding of the invention and to show how the invention may be carried into effect, reference should be made to the accompanying drawings and the following detailed description.

BRIEF DESCRIPTION OF THE DRAWING

FIG. 2, 3, 4 and 5 are perspective views of playing blocks, which are used in accordance with the present invention.

FIG. 6 is a perspective view of a return and surplus tray which is used to receive remaining playing pieces from the board and provide surplus pieces to the selector holder on each player's turn.

FIG. 7 is a front view of the associated playing pieces selector holder according to the present invention.

DETAILED DESCRIPTION OF THE PREFERRED EMBODIMENT

Figure 1:
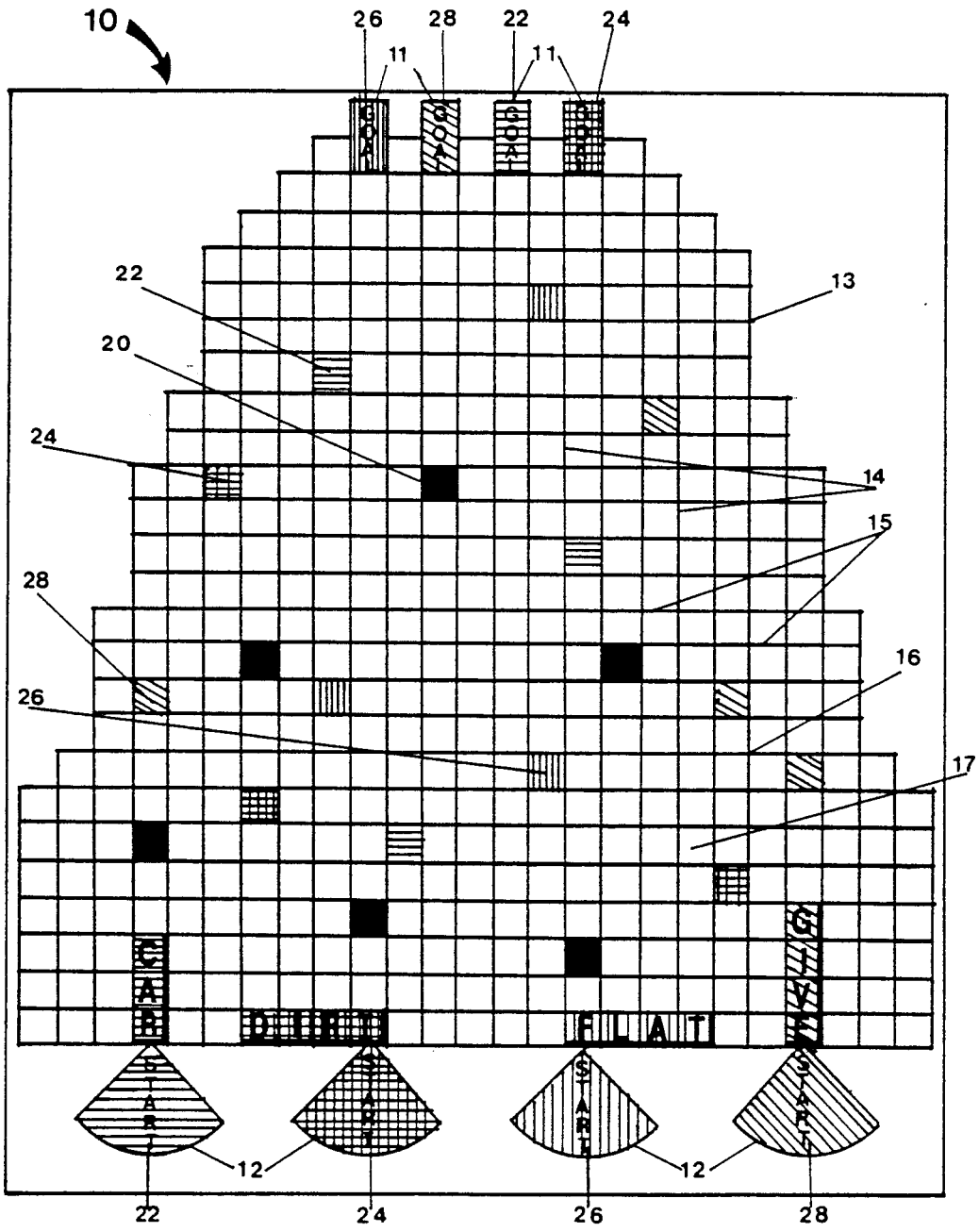
FIG. 1 is a plan view of the game board for four in accordance with a preferred embodiment of the invention, showing the grided section printed thereon with black, colored and colorless squares. Also shown are four colored goals at the top and four marked starting points at the base of the board.
Figure 1A:
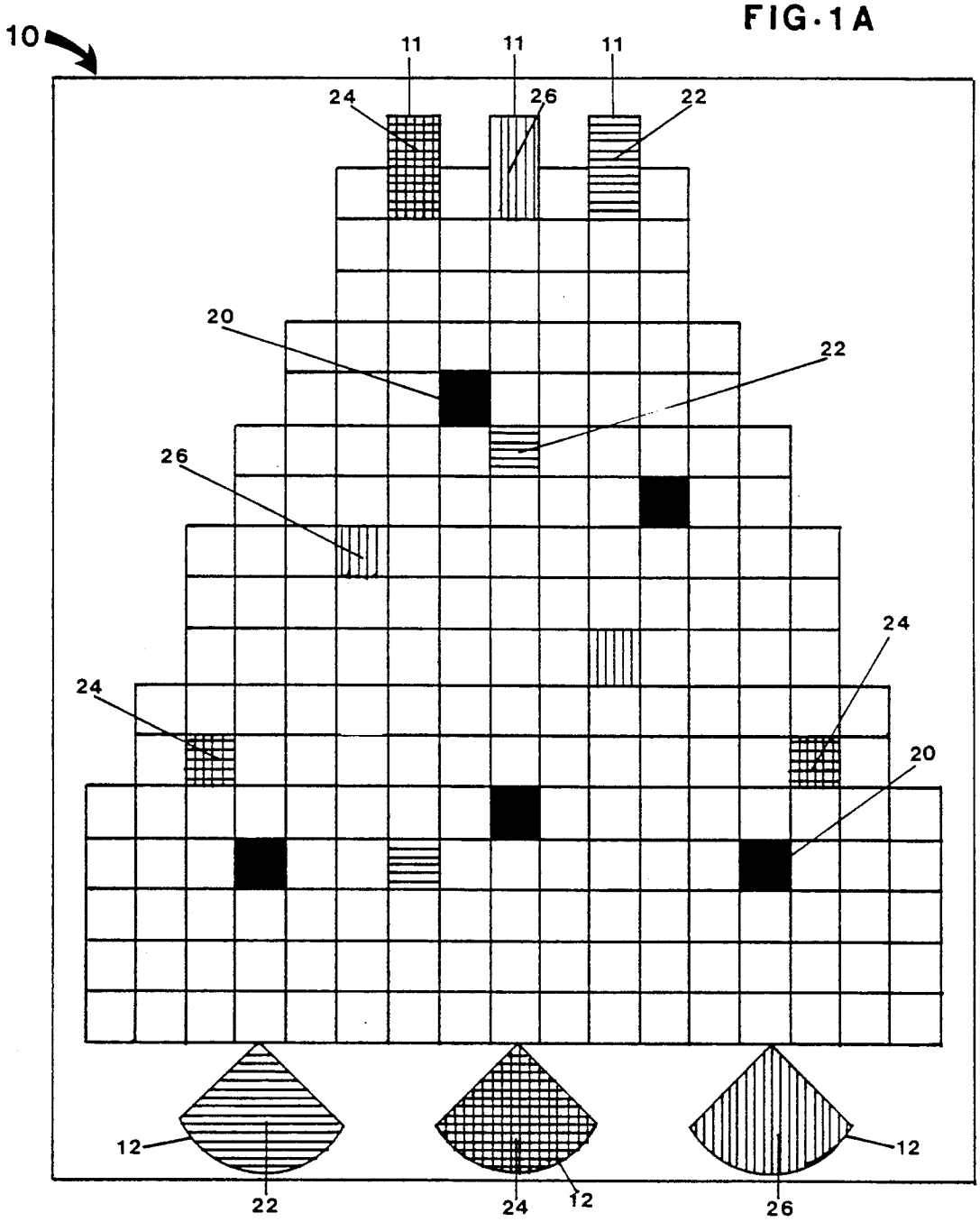
FIG. 1A shows a plan view of an alternative game board for three players.

By referring to FIGS. 1 and 1A, one is shown a plan view of the game board 10 as used in the present invention. As shown in FIGS. 1 and 1A, the game board 10 is of a triangular form so that the players can regroup their words in the top of the game area and to provide more enjoyment and difficulty in the process of playing the game. Board 10 of FIGS. 1 and 1A is made of a flat hard surface out of suitable material such as cardboard, wood, metal, plastic or other desirable material. Board 10 can be square or rectangular in form, but the game area 13 should remain in a triangular or trapazoidal form. It is designed with color starting points at its base 12, and color goals of finishing points 11 at its top. The game board of the present invention cannot be played by more than it has been designed for but may be played by less. In FIG. 1A, the board 10A has been designed with three colored marked starting points 12 and three color goals 11. In FIG. 1, which is designed with four marked starting points 12 and four color goals, the board 10 is provided with a playing surface 13 which is divided by perpendicular and parallel strips or lines which intersect at 90° angles 16 which divide the playing surface into a multiplicity of equal sized squares or spaces 17. The size of each playing square 17 and of the whole game area 13 is of course related to the size of the playing pieces 30 which must be placed on the squares during the process of the game. Some of the squares 17 have a color indicia which relates to the player's color set. As shown in the Figures, 22 designates RED, 24 designates YELLOW, 26 designates GREEN and 28 designates BLUE. The other squares which remain colorless 17 are nutral and are used by all players upon which to lay their blocks. The purpose of the BLACK SQUARES 20 is to veer-off course the other player's words. They cannot be used like a joker in the player's words and cannot be crossed or jumped by a word. It may be used to hyphenate a word depending upon the rules to be followed. (For example: in the word PING-PONG you would place the letters for PING, BLACK SQUARE, and then the letters for PONG.)

The colored squares 22 on the game area 13 of FIGS. 1 and 1A which relate to the player using the playing pieces 30 carrying the same indicia of color 22 (FIG. 2) which use the marked starting point 12 and the color goal 11 with the same indicia of color 22, may be used as a joker in his word and can replace any vowel or consonant needed. Those color squares 22, shall not be used by the other players and will have the same function as a black square 20 for the other players.

The colored squares 24 on the game area 13 of FIGS. 1 and 1A which relate to the layer using the playing pieces 30 carrying the same indicia of color 24 (FIG. 3) which use the marked starting point 12 and the color goal 11 with the same indicia of color 24, may be used as a joker in his word and can replace any vowel or consonant needed. These color squares 24, shall not be used by the other players and will have the same function as a black square 20 for the other players.

Likewise, the colored squares 26 on the game area 13 of FIGS. 1 and 1A which relate to the player using the playing pieces 30 carrying the same indicia of color 26 (FIG. 4) which use the marked starting point 12 and the color goal 11 with the same indicia of color 26, may be used as a joker in his word, and can replace any vowel or consonant needed. These color squares 26 shall not be used by the other players and will have the same function as a black square 20 for the other players.

The colored squares 28 on the game area 13 of FIG. 1 (only) which relate to the player using the playing pieces 30 carrying the same indicia of color 28 (FIG. 5) which use the marked starting point 12 and the color goal 11 with the same indicia of color 28, may be used as a joker in his word, and can replace any vowel or consonant needed. These color squares 28 shall not be used by the other players and will have the same function as a black square 20 for the other players.

The color squares 28 of FIG. 1 and 20, 22, 24 and 26 of FIGS. 1 and IA can be applied in any suitable manner to the surface 13 of the game board 10. In a modification of the game board, to improve easiness or difficulty in the process of the game, black squares 20 or colored squares can be added or subtracted to the playing surface 13 of the game board 10. The colored squares 28, of FIG. 1, 22, 24 and 26 of FIGS. 1 and 1A must be added or subtracted to the playing surface in a way to have the same quantity of color squares for each color set.

The playing pieces or blocks 30 adapted for use in the present invention are shown in FIGS. 2, 3, 4 and 5 of the drawing. They are made of suitable material such as wood, metal, plastic or other desirable material, and bearing first indicia which in the case of FIGS. 2, 3, 4 and 5 comprises a letter of the alphabet: for example E 32, A 34, T 36, and O 38. All of the blocks bear a second identifying means, which is a color to identify each player's pieces. In FIG. 2 the reference numeral 22 represents RED; in FIG. 3 the reference numeral 24 represents YELLOW, in FIG. 4 the reference numeral 26 represents GREEN, and in FIG. 5 the reference numeral 28 represents BLUE. The blocks 30 are of approximately the size as the area of a square 17. In the embodiment of the game board illustrated in FIGS. 1 and 1A, the blocks are placed adjacent to each other in an end to end, or side to side alignment.

Figure 8:
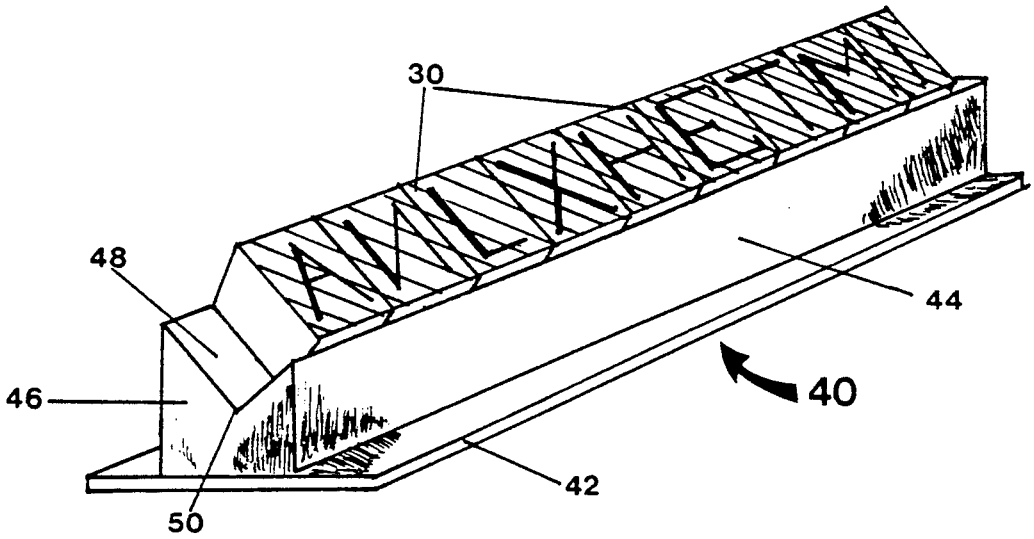
FIG. 8 is a perspective view of a preferred embodiment of the playing pieces selector holder.
Figure 9:
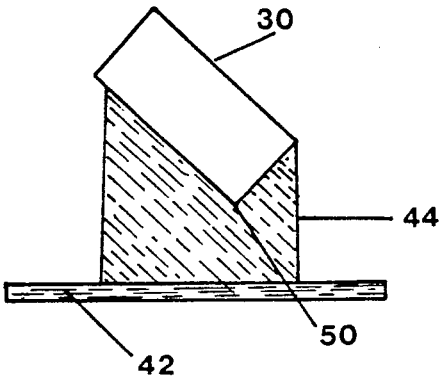
FIG. 9 is a cross section view of the selector holder in accordance with the present invention.

Referring now to FIGS. 6, 7 and 8, there is shown the playing pieces or blocks 30 selector holder shown generally at 40. The selector holder 40 preferably comprises a base 42, a front wall 44, side walls 46 and a top portion 48 which has a groove 50 at an angle of 90° to lay blocks in a face up position ready to play. In the course of the game, the blocks selector holder 40 must always be refilled with the randomized drawing of playing pieces 30 from the surplus section 62 of the tray. The selector holder 40, adapted for use in the present invention, as shown in FIGS. 7, 8 and 9 must be made of a suitable material such as cardboard, wood, metal, plastic or other desirable material.

Referring now to FIG. 6, there is shown the randomized playing pieces 30 in a rectangular or square surplus and return tray, shown generally at 52, made of a suitable material such as cardboard, wood, plastic or other desirable material. The tray 52 includes a bottom 54, four side walls 56, and a center separation wall 58 which splits the tray 52 in two equal sections 60, one being a surplus section 62 which will be used for supplying playing pieces 30 to the selector blocks holder 40 and the other being a return section 64 for returning remaining playing pieces 30 from the game board 10 with the letters facing down. When the supply section 62 of the tray is empty, the player will use the letters from the return section 64 which will then become the surplus section. The supplying section 62 will then become the return section.

The game will now be described in greater detail by way of example.

In the preferred embodiment of the invention, the playing blocks 30 number 120–140 pieces. Each of the face segments of the blocks 30 is adapted to carry first indicia of alphabetic characters, and second indicia representing a player's color. In the preferred embodiment, each player's set of playing pieces 30 shall be composed of 10 alphabetic vowels and 20 alphabetic consonants based upon their frequency of occurrence in the English language. It can be seen that the invention may be adapted for other languages by using an alphabetic frequency table for the other languages. The game may be conveniently played by from two to three players on a game board for three (FIG. 1A) or two to four players on a game board for four (FIG. 1).

Prior to beginning the game, each player selects a color and receives a selector block holder 40, a return and surplus tray 52 and alphabetic color blocks 30 of the same color as that which the player has selected. Each player will place all their blocks in the surplus section 62 of the tray 52, with the letters facing down, leaving the other section empty. All players will draw 9 blocks from the surplus section of the tray and position them in the grooves of the block holder 40 with the letters facing up. The player who chose the color set corresponding to the marked starting point 10, the closest to the left hand edge of the board 10 will be the first to play (FIG. 1 and 1A RED). Play preferably is passed to the right hand of that player and then each in turn.

All plays must be based on words found in the dictionary which is agreed to by the players. Hyphenated words may be permitted only if the hyphen of the word can be replaced by a black square in the game area, if this is agreed to prior to the commencement of the game. For example in the word PING-PONG, the player would place the letters for PING, BLACK SQUARE, and then the letters for PONG. Common abbreviations (such as USA, SOS, UPS, TWA, etc.) are also permitted when agreed upon by the players prior to the start of the game. The dictionary may only be consulted when a controversy is made. Any challenge to a colored word must be made before the next player takes his turn Depending upon what is agreed upon prior to the commencement of the game, if a word is made in error, the player must reform his previous word and wait until his next turn or return all the playing pieces he has used to the return section 64 of the tray 52 and wait until his next turn to start again from the starting point. Again, this will depend on the rules agreed upon prior to the commencement of the game.

The play begins by forming a colored word using only his own color blocks at his starting point. The words must always start or finish on the starting square identified by the starting point indicator. Words must be spelled and read in the right order. All players must begin this way in the first turn. The players must then refill their block holder 40 with the same number of blocks used to form their word by using the blocks from the surplus section 62 of the tray 52. The players must always have 9 blocks in their selector holder 40. The game ends when at least one player's colored blocks remain on the board. To win this game, the winner must be the first player entering his color goal or finish point with at least one letter of his word. If in a turn more than one player enters their color goal, the winner will be the one which has the most letters in his word on the color goal.

Figure 10:
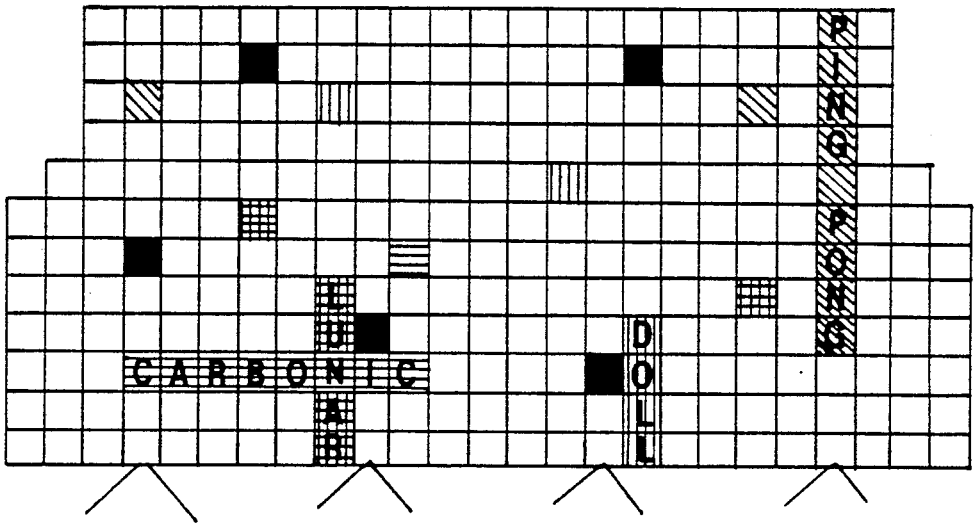
FIGS. 10 and 11 is a partial plan view of the game board as in FIG. 1 illustrating the formation of words in accordance with the preferred embodiment.

Reference is now made to FIGS. 1 and 10 of the drawings. FIG. 1 shows a different way of starting by each player. In FIG. 1, the first player having indicia of color 22 (red) wrote the word CAR going up and down and having the last letter of the word on the starting square of his color starting point. The second player having indicia of color 24 (yellow) wrote the word DIRT across the board, having the last letter of the word on the starting square. The third player having indicia of color 26 (green) wrote the word FLAT across the board, having the first letter of the word on the starting square. The fourth player having indicia of color 28 (blue) wrote the word GIVE up and down the board having the last letter of the word on the starting square.

FIG. 10 illustrates one possible way of forming a new word on the second turn by using one letter from the previous word and returning the remaining blocks to the return section 64 of the tray 52.

In the second turn, the player having indicia of color 22 wrote a new word using the first letter of his previous word (C) and formed the word CARBONIC across the board and obstructed the way up for the player having indicia of color 24. He then returned the letters A and R from his previous word to the return section 64.

In the second turn the player having indicia of color 24 wrote a new word: LUNAR by using the third letter from his previous word (R) and returned the remaining D, I and T to the return section 64 of the tray 52. He crossed the word CARBONIC by using the letter N from this word.

In the second turn the player using indicia 26 wrote a new word DOLL up and down the board by using the second letter (L) from his previous word and returning the remaining F, A and T to the return section 64 of the tray 52.

In the second turn the player having indicia of color 28, this player wrote a hyphenated word PING-PONG up and down the board by using the first letter (G) from his previous word and returning the remaining I, V and E to the return section 64 of the tray 52 and using the BLACK SQUARE to hyphenate the word. This may be done only if agreed to prior to the commencement of the game.

Figure 11:
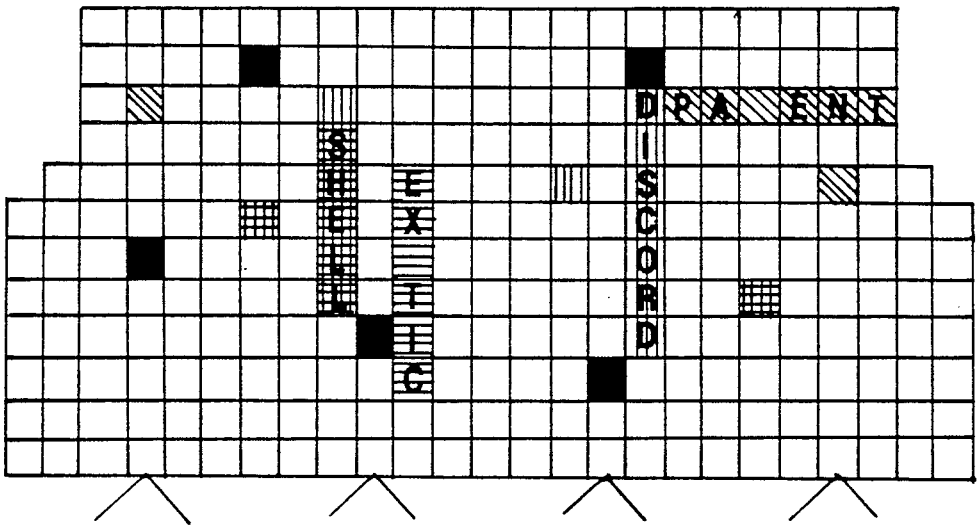

FIG. 11 illustrates the way of forming a new word in the third turn. During the third turn, the first player having indicia of color 22 writes the word EXOTIC (up and down the board) by using the last letter C from his previous word CARBONIC, crossing and using as a joker the colored square having indicia of color 22, the same as that player's color, to replace the letter O from his new word. Then, the player will return the remaining letters C, A, R, B, 0 and I to the return section 64 of his tray 52 and leave the letter N on the board. The letter N will be returned to the player's tray 52 after the player having indicia of color 24 has formed a new word.

During the third turn, the second player having indicia of color 24, forms the word SHELL (up and down the board) by using the first letter L from his previous word LUNAR. and returning to the return section 64 of the tray 52 the letters U, A and R. He will also return the letter N to the player's tray who has the indicia of color 22. During the next turn this player will not be allowed to go straight up, due to the presence of the color square 26 (yellow). That player will have to form the new word across the board by using any letter from his previous word.

During the third turn, the third player having indicia of color 26 forms the word DISCORD (up and down the board) by using the first letter D from his previous word DOLL and returning the remaining letters O, L and L to the return section 64 of his tray 52. During the next turn, the player will not be allowed to go straight up the board due to the presence of a BLACK SQUARE and will have to write the new word across the board by using any letter from the previous word.

During the third turn, the fourth player having indicia of color 28 forms a new word PATENT by using the letter N from the previous word ping-pong and adding to it the letters P, A, E and T and using the color square of indicia 28 (BLUE) as a joker in his word to replace the letter T. Then he returns the remaining letters from the word ping-pong to the return section 64 of his tray 52. This is continued until at least one player reaches the respective color goal of finish point. If two or more players reach this point during the same numbered turn, the player with the most letters accumulated in the color goal is declared the winner.

The above description of the process in which the game is played is set forth merely as an example and various modifications may be made without departing from the spirit and scope of the invention. It is, therefore, to be understood that the spirit and scope of the present invention be limited only by the appended claims.

I claim:

1. A board game, comprising:

a plurality of coded sets of playing pieces, each of said coded sets of playing pieces having a coding means, definite configuration and indicia means on at least one surface thereof for distinguishing them from other sets of coded playing pieces and for forming a word when positioned adjacent other of similarly coded playing pieces;

a game board having a flat surface for receiving thereon said coded playing pieces;

a grid of plurality of essentially equal spaces formed of intersecting lines conforming substantially to the configuration of said playing pieces, with said grid defining a boundary of a playing surface of said flat surface;

at least two coded starting points corresponding to the coding means of the sets of coded playing pieces and positioned adjacent the boundary and at least two corresponding coded finishing points corresponding to the coded starting points and positioned adjacent the boundary; and a plurality of randomly spaced obstacle means positioned about said grid, said obstacle means being coded spaces and are obstacles for dissimilar coded playing pieces of each set.

2. The game board as defined in claim 1, wherein said sets of coded playing pieces, said coded starting and finishing points and said plurality of coded spaces are color coded.

3. The game board as defined in claim 1, wherein the boundary of said playing surface forms a polygon having sides of varying length, and said coded starting points are positioned adjacent a longer side than said coded finishing points.

* * * * *